US006135656A

United States Patent [19]

Kato et al.

[11] Patent Number: 6,135,656

[45] Date of Patent: Oct. 24, 2000

[54] INK-JET PRINTING METHOD AND APPARATUS FOR PERFORMING PRINTING BY EMPLOYING INK AND PROCESSING LIQUID MAKING INK INSOLUBLE

[75] Inventors: Minako Kato; Shigeyasu Nagoshi; Masao Kato, all of Yokohama, Japan

[73] Assignee: Canon Kabushiki Kaisha, Tokyo, Japan

[21] Appl. No.: 09/104,674

[22] Filed: Jun. 25, 1998

[30] Foreign Application Priority Data

Jun. 26, 1997 [JP] Japan ..... 9-170096

[51] Int. Cl.[7] ..... B41J 2/315

[52] U.S. Cl. ..... 400/120.15; 347/14; 347/37; 347/41; 347/9

[58] Field of Search ..... 400/120.09, 120.15; 347/5, 6, 14, 37, 40, 41, 9, 8, 101, 98

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,359,355 | 10/1994 | Nagoshi et al. | 347/9 |
| 5,541,625 | 7/1996 | Holstun et al. | 347/37 |
| 5,719,601 | 2/1998 | Moore et al. | 347/37 |
| 5,864,013 | 3/1999 | Bosschaerts et al. | 347/131 |
| 5,864,350 | 1/1999 | Shioya et al. | 347/40 |
| 5,902,053 | 5/1999 | Ikemoto et al. | 400/120.09 |
| 5,917,379 | 6/1999 | Arai et al. | 347/37 |
| 5,959,641 | 9/1999 | Yokoi | 347/21 |
| 6,012,809 | 1/2000 | Ikeda et al. | 347/101 |
| 6,062,674 | 5/2000 | Inui et al. | 347/43 |

FOREIGN PATENT DOCUMENTS

| | | |
|---|---|---|
| 0 726 158 A1 | 8/1996 | European Pat. Off. . |
| 0 845 356 A2 | 6/1998 | European Pat. Off. . |
| 53-24486 | 3/1978 | Japan . |
| 54-43733 | 4/1979 | Japan . |
| 54-56847 | 5/1979 | Japan . |
| 55-150396 | 11/1980 | Japan . |
| 58-128862 | 8/1983 | Japan . |
| 59-123670 | 7/1984 | Japan . |
| 59-138461 | 8/1984 | Japan . |
| 60-71260 | 4/1985 | Japan . |
| 5-330083 | 12/1993 | Japan . |
| 8-052867 | 2/1996 | Japan . |
| 8-52868 | 2/1996 | Japan . |
| 8-316117 | 11/1996 | Japan . |
| 9-226154 | 9/1997 | Japan . |
| 10-157113 | 6/1998 | Japan . |

*Primary Examiner*—Eugene Eickholt
*Attorney, Agent, or Firm*—Fitzpatrick, Cella, Harper & Scinto

[57] ABSTRACT

On the basis of an image data for one line, ejection data is established distributed ejection data in a period of two pixels for each scan for performing printing by scanning twice with different ejection openings. Then, a processing liquid data is generated with a processing liquid mask of a period of three pixels which is prime to the period of two pixels, with respect to the ejection data. By this, with respect to results of a first scan and a second scan, pixels, on which an ink and a processing liquid are overlaid can be distributed uniformly. As a result, it is never differentiate order of application of the processing liquid by performing printing in the order of second scan and the first scan in other scanning region from correspondence of the ejection openings.

16 Claims, 12 Drawing Sheets

PIXEL TO BE PRINTED

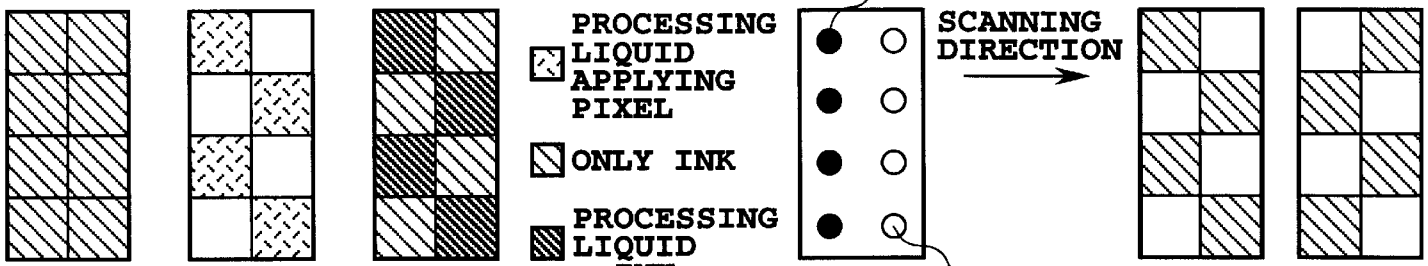
FIG.12A
FIG.12B
FIG.12C
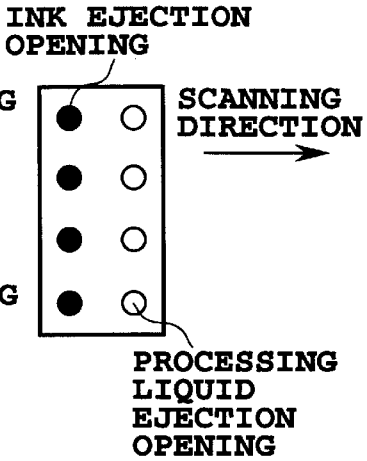
FIG.12D
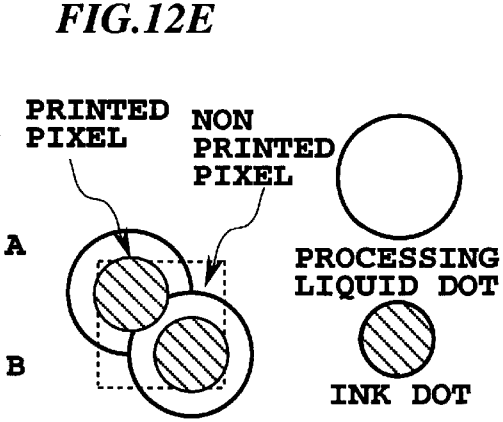
FIG.12E
FIG.12G
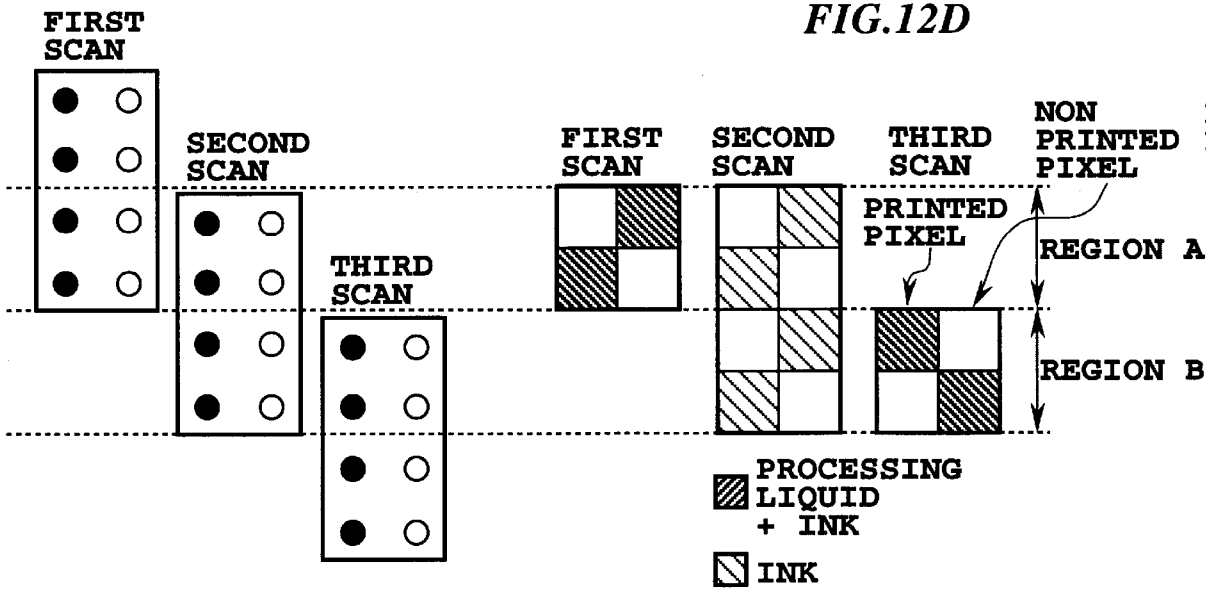
FIG.12F

INK-JET PRINTING METHOD AND APPARATUS FOR PERFORMING PRINTING BY EMPLOYING INK AND PROCESSING LIQUID MAKING INK INSOLUBLE

This application is based on patent application No. 170,096/1997 filed on Jun. 26, 1997 in Japan, the content of which is incorporated hereinto by reference.

BACKGROUND OF THE INVENTION

1. Field of the Invention

The present invention relates generally to an ink-jet printing method and an apparatus, and particularly, to an ink-jet printing method and an apparatus in which a liquid making a coloring agent of an ink insoluble or coagulated, is applied to the ink in an overlapping manner.

2. Description of the Related Art

Conventionally, an ink-jet printing method has been widely used in printer, copy machine and so on, for a low noise, a low running cost, an easiness of down-sizing of an apparatus, an easiness of color printing and other various advantages.

In the case of printing of an image on a printing medium, particularly on the printing medium called as a plain paper by apparatuses employing the ink-jet printing method, it is possible that water resistance of the image on the printing medium may have been insufficient. Also, upon printing of a color image, especially of a high density color image, difficulty may have been encountered in achieving both of suppression of feathering and preventing from bleeding between different colors. Therefore, it has been relatively difficult to obtain a high quality color image having high image fastness.

As a method for improving the water resistance of the image printed on the printing medium, inks provided water resistance for a coloring agent contained therein have been practiced in the recent years. However, even with such ink, water resistance of the ink has not yet been sufficient. In addition, as a nature, such type of the ink is difficult to solve in water after once dried to possibly cause plugging in ejection openings and the like of a printing head. Furthermore, in order to prevent plugging in the ejection openings and the like, a construction of the apparatus becomes complicate.

It has also been known a large number of technologies in improving fastness of printed products. For example, in Japanese Patent Application Laid-open No. 24486/1978, a technology for fixing a dye by laking through a post-processing of dyed product in order to increase wet color fastness of the dyed product.

Also, in Japanese Patent Application Laid-open No. 43733/1979, there has been disclosed a method for performing printing by using two or more components which increase layer forming ability under normal temperature or heating when the components are mutually contacted, by means of the ink-jet printing system. By the disclosed method, a printing product with firmly fixed layer has been obtained by contacting the respective components on a printing medium.

Furthermore, in Japanese Patent Application Laid-open No. 150396/1980, there has been disclosed a method for applying a waterproofing agent which forms a color lake with the dye after printing by a water-base dye ink.

Also, in Japanese Patent Application Laid-open No. 128862/1983, there has been disclosed an ink-jet printing method, in which an image position to be printed is preliminarily identified and a printing ink and a processing ink are applied in an overlapping manner. In this publication, there has been disclosed methods printing the image with the processing liquid in advance of printing with the printing ink, printing with the processing ink overlapping on the image preliminarily printed by the printing ink, or overlappingly printing with the printing ink over the image preliminarily printed by the processing ink and further printing with the processing ink thereover.

Furthermore, in Japanese Patent Application Laid-open No. 52867/1996 of the assignee of the present application, there has been disclosed a method of applying a processing liquid which makes a coloring agent of the ink insoluble or coagulated, over each pixel at a predetermined ratio.

In addition, in Japanese Patent Application Laid-open No. 226154/1997 of the assignee of the present application, attention has been paid for an edge portion of the image to be printed to eject the processing liquid at the predetermined ratio for the portion other than the edge portion of the image, and on the other hand, to eject the processing liquid over the edge portion of the image entirely so as to certainly attain the water resistance with avoiding unnecessarily wasting the processing liquid.

It should be noted that the foregoing processing liquid is effective not only for improving to water resistance of the printed image but also for increasing density, avoiding bleeding and so on. In such viewpoint, the processing liquid will also be referred to as a printing ability improving liquid. Namely, throughout the present specification, the wording "processing liquid" and the wording "printing ability improving liquid" are used in the same meaning.

In the ink-jet printing apparatus, it has been known that a problem is encountered in degrading the image quality caused due to density unevenness.

One of primary causes of the density unevenness is slight errors in heater portion, shape of the ejection openings and so on in the printing head caused during manufacturing process thereof. Such error should cause fluctuation of ink ejection amounts and/or of ejecting direction of respective ejection openings during printing to result in the density unevenness on the printed image.

FIGS. 9A to 9C show one example of the density unevenness caused in the printed image. FIG. 9A is a diagrammatic illustration showing the printing head constituted of eight ink ejection openings and also showing fluctuation caused in volume and direction of the ink ejected through respective ink ejection openings. When printing is performed using such printing head, dots different in a size and a position for respective rows respectively corresponding to the respective ink ejection openings are formed, as shown in FIG. 9B. As a result of this, the density unevenness so-called white stripe, in which non-printed blank portion is cyclically expressed in relatively strong or so-called black stripe, in which adjacent dots overlap excessively, and so on may be caused. FIG. 9C shows a density distribution of such dots formed as described above.

On the other hand, as a system for solving the density unevenness due to fluctuation of ejection characteristics for each individual ejection opening as set forth above, it has been well known that a multi-path system (or multi-scanning system) is effective. This system is a system for printing pixels in each line in a primary scanning direction by a plurality times of scan and for forming dots in each line with ink ejected through a plurality of mutually different ink ejection openings, or a system for printing each of pixels in each line by a plurality of times of scan to form each pixel with inks ejected from a plurality of mutually different ink ejection openings. The later system is the multi-path system to be employed in a multi-tone printing or density enhancing printing for printing each pixel with a plurality of ink droplets.

FIGS. 10A to 10C are explanatory illustrations in the case where the former multi-path system is implemented with the same printing head as that of FIG. 9A. As shown in FIG. 10A, the eight ejection openings of the printing head is divided into two groups respectively consisted of upper four ejection openings and lower four ejection openings. Also, dots to be formed through one scan by respective ejection openings in respective group correspond a thinned image data which is thinned into substantially half from one line of an original image data by a predetermined method. After printing for one scan, paper feeding for four pixels is performed to oppose ejection openings different from those use in the preceding scan (in different group), to the line to be printed for forming dots on a basis of the remaining half of the image data to finally complete printing of the line. Thus, each of raster (one line in the scanning direction) can be printed with inks ejected from different ejection openings. Therefore, influence of fluctuation of the ejection characteristics for each ejection opening can be reduced and whereby to reduce density unevenness in the printed image, as shown in FIGS. 10B and 10C.

Various dividing method of the image data in the multi-path system identifying dots in each line to be printed in each scan have been disclosed, conventionally. In addition to the dividing method employing a fixed mask thinning data per each dot (each pixel) as set forth with reference to FIGS. 9A to 9C, there has been known a sequential multi-scanning system (hereinafter referred to as SMS), in which ejection openings to be used for respective lines are varied cyclically, as disclosed in Japanese Patent Application Laid-open No. 330083/1993. A method for performing enhancing or thinning printing employing the foregoing SMS has been proposed in Japanese Patent Laid-open No. 157113/1998 of the assignee of the present application.

However, the inventors of the present application have found the following new problems to be encountered in application of the foregoing processing liquid in the foregoing multi-path system.

In general, the ink and the processing liquid may extend beyond the pixel to be printed when they are applied to a printing medium, such as a printing paper or the like. Particularly, when the ink or the processing liquid having high permeability is used or when the ejection amount per one pixel is sufficiently large, a diameter of the dots formed on the printing medium may become greater for spreading of the ink or the like. As a result of this, in certain case, overall surface of the printing medium may be covered with the ink or the processing liquid without requiring application of the ink or the processing liquid for all of the pixels. FIGS. 11A to 11C show the case where overall surface of the printing medium can be covered with the ink and the processing liquid without applying the ink or the processing liquid for all of the pixels.

FIG. 11A is a diagrammatic illustration of the image data in the case where an ejection duty is set at 50% in an image to be printed at a pixel pitch of 600 dpi. Namely, each pixel is expressed as a region defined by a grid of 42 $\mu$m. By applying the ink or the processing liquid in the pixel shown with hatching to establish 50% ejection duty.

FIG. 11B is an illustration showing an example where the dot diameter on the surface of the printing medium is large for high permeability of the ink or the processing liquid, or for large ejection amount. In the shown example, the dot diameter is 80 $\mu$m. As shown in FIG. 11B, while the ejection duty of the data for applying the ink is 50%, the ink or the processing liquid may cover the entire surface of the printing medium with enlarging of the dot diameter due to spreading of the ink or the like on the surface of the printing medium.

In contrast to this, when the dot diameter is small because the permeability of the ink or the processing liquid is relatively low or because the ejection amount is small, a region not covered by the ink or the processing liquid may be formed on the surface of the printing medium, as shown in FIG. 11C. In such case, unless the ink or the processing liquid is applied with the ejection duty of 100%, the entire surface of the printing medium cannot be covered. In the example shown in FIG. 11C, the dot diameter is about 50 $\mu$m.

As shown in FIG. 11B, when the entire surface of the printing medium is covered with the processing liquid without no blank portion, the processing liquid may achieve effect for improving the printing ability. In this case, by generating the data for applying the processing liquid corresponding to the printing data (data for ejecting the ink), the processing liquid can be effectively applied to the pixels, to which the ink is applied. In such case, when thinning the processing liquid ejection data in taking account of spreading of the processing liquid and applying a necessary minimum amount of the processing liquid, application amount of the processing liquid can be restricted to be small. Also, reducing the application amount of the processing liquid is also effective for suppressing occurrence of cockling due to wetting of the printing paper. Furthermore, reduction of application amount of the processing liquid may contribute for lowering of a running cost.

However, when printing in the multi-path system is to be performed, it is possible that the application pattern of the processing liquid becomes synchronous with the mask of the multi-path in certain thinning method of the processing liquid to negate the effect of the multi-path system. One example of such case will be explained with reference to FIGS. 12A to 12G.

FIG. 12A shows an image data for printing an image consisted of four pixels in the longitudinal direction and two pixels in the lateral direction. When the processing liquid is applied in a pattern thinned into 50% as shown in FIG. 12B for this printing data, the dots formed with the ink and the processing liquid and the dots formed only with the ink are arranged in a checkered pattern, as shown in FIG. 12C. In this case, in order to effectively improve the printing ability, the system is constructed to print the processing liquid and the ink are printed in the same scan so that the processing liquid is applied immediately before printing by the ink.

For simplification, it is assumed that the image shown in FIG. 12C is printed by the printing head having respective four ink ejection openings for respective of the ink and the processing liquid as shown in FIG. 12D. In this printing head, the ejection opening groups for respective of the ink and the processing liquid are arranged along the scanning direction so that the processing liquid is applied to each pixel in advance of application of the ink.

On the other hand, a division mask used for the multi-path printing is a fixed mask in the checkered pattern for the thinning method for completing the image by two path (two scans) shown in FIG. 12E. More specifically, as shown in FIG. 12E, by printing the pixels identified by respective hatching in the first scan and the second scan, data is mutually complemented by scanning twice.

FIG. 12F illustrates a method for printing the image of FIG. 12A employing the thinning mask of FIG. 12E by the printing head of FIG. 12B. At first, by scanning (first scan) of the printing head at the first time, diagonally positioned two dots of pixels are formed. These two pixels are pixels, to which the processing liquid is applied with the mask for the processing liquid (FIG. 12B). By this, on these two pixels, the dot in which the processing liquid and the ink are overlaid is formed. Next, after paper feeding (the drawing is illustrated as if the head is moved) for two ejection openings, a second scan is performed. In the second scan, the mask of the second scan shown in FIG. 12E is used. However, the pixels to be printed at this second scan are the pixels, to which the processing liquid is not applied in accordance with the mask for the processing liquid shown in FIG. 12B. More specifically, the mask for the processing liquid (FIG. 12B) and the mask for ink ejection (FIG. 12E) are synchronized. As a result of this, in the second scan, the processing liquid is not applied at all and only the ink is applied. In the final, third scan printing, the mask of the first scan shown in FIG. 12E is used to overlay the processing liquid with the ink.

In FIG. 12F, while an arrangement of dots is diagrammatically illustrated, the actually printed dots have greater dot diameter to be possibly applied to a periphery of the pixel beyond the boundary of the pixel (FIG. 12G). In this case, in FIG. 12F, a region can be divided into two regions A and B depending upon an order of sequent in applying the processing liquid. In a region (region A) where the processing liquid is applied in the first scan, the processing liquid is widely spread in the first scan as shown in FIG. 12G. It is equivalent to the case where the processing liquid is applied even for the pixel to be not printed. In the region A of FIG. 12F, only ink is applied to the non-printing pixel at the first scan in the second scan. From the foregoing, the processing liquid has been already spread even in the pixel to be printed only by the ink. Therefore, it becomes equivalent to print all of the pixels of the region A in the sequential order of the processing liquid and then the ink.

On the other hand, in the region (the region B) in which, among the twice scan for the region, only ink is applied in the first scan, and both the processing liquid and the ink is applied in the next scan, to the pixel printed in the first scan, the ink is applied at first, and next, the processing liquid spreaded from adjacent pixels is overlaid on the ink. More specifically, in the pixel printed in the first scan, the ink and the processing liquid are overlaid in the sequential order of the ink and then the processing liquid. In contrast to this, the pixel to be printed in the later scan, the processing liquid is applied, at first, and subsequently the ink is applied.

As set forth above, to the region A, the ink is applied after application of the processing liquid over substantially all region. In contrast to this, in the region B, to half in number of pixels, the ink and the processing liquid are applied in the sequential order that the processing liquid is applied at first and then the ink is applied. In the remaining half in number of pixels, the ink and the processing liquid are applied in sequential order that the ink is applied at first, and then the processing liquid is applied.

The printing color of the ink may be varied in case of use together with the processing liquid, and the printing color may also be varied depending upon the sequential order of application of the processing liquid and the ink. Therefore, the printing colors in the region A and B can be different. As a result, in the paper feeding direction of the printing image, the printing region corresponding to the region A and the printing region corresponding to the region B appears alternately to cause stripe form color fluctuation or density unevenness.

As set forth above, when the processing liquid is applied in accordance with thinned data, degradation of image quality can be caused by the color irregularity or the density unevenness due to difference of sequential order in application of the processing liquid at respective regions depending upon the order to scan in the multi-path printing.

Since the processing liquid is unevenly ejected for each scan, reduction of influence of fluctuation of the ejection characteristics for each ejection opening becomes not effective. Also, an amount that the ink and the processing liquid are ejected simultaneously can be increased to cause an adverse effect.

SUMMARY OF THE INVENTION

An object of the present invention is to provide an ink-jet printing method and an ink-jet printing apparatus in which two kinds of liquids, such as an ink and a processing liquid, are applied in overlaying manner and the one of the liquids, such as the processing liquid is applied with thinning, and which can reduce color irregularity or density unevenness caused by using multi-path system.

Another object of the present invention is to provide an ink-jet printing method and an ink-jet printing apparatus in which, when printing is performed with the ink and the processing liquid thinned at a predetermined ratio relative to the ink, printing of a plurality of lines are performed by a plurality of times of scanning of the printing head ejecting the ink, by ejecting the processing liquid in respective of a plurality of times of scanning in respective lines, so that unevenness in an order of overlaying of the processing liquid and the ink in each line can be eliminated.

In the first aspect of the present invention, an ink-jet printing apparatus for performing printing on a printing medium by using a printing head having a plurality of ejection openings for ejecting an ink and printing head having a plurality of ejection openings for ejecting the processing liquid so as to eject the ink and the processing liquid ejection data of which is thinned at a predetermined ratio with respect to ejection data of the ink, comprises:

ink head control means for scanning the printing head for a plurality of times on the printing medium, and performing printing of a plurality of lines of an image by making to different ejection openings correspond to respective of the plurality of times of scanning; and processing liquid head control means for controlling the printing head ejecting the processing liquid to eject the processing liquid, the processing liquid head control means making the printing head eject the processing liquid in each of the plurality of times of scanning in the printing performed by the ink head control means so that the processing liquid the ejection data of which is thinned at the predetermined ratio is ejected to each of the plurality of lines.

In the second aspect of the present invention, an ink-jet printing apparatus for performing printing on a printing medium by using a printing head having a plurality of ejection openings for ejecting an ink and printing head having a plurality of ejection openings for ejecting the processing liquid so as to eject the ink and the processing liquid ejection data of which is thinned at a predetermined ratio with respect to ejection data of the ink, comprises:

control means for making the printing head ejecting the processing liquid eject the processing liquid in each of the plurality of times of scanning so that the processing liquid the ejection data of which is thinned at the predetermined ratio is ejected to each of a plurality of lines, when performing printing the plurality of lines of an image by making different ejection openings correspond to respective of the plurality of times of scanning in associating with relative moving of the printing head ejecting the ink to the printing medium; and reception means for receiving respective ejection data for respective of the printing head ejecting the ink and the printing head ejecting the processing liquid, which are made eject the ink and the processing liquid by the control means, respectively, from a host unit.

In the third aspect of the present invention, an ink-jet printing method for performing printing on a printing medium by using a printing head having a plurality of ejection openings for ejecting an ink and printing head having a plurality of ejection openings for ejecting the processing liquid so as to eject the ink and the processing liquid ejection data of which is thinned at a predetermined ratio with respect to ejection data of the ink, comprises the step of:

making the printing head ejecting the processing liquid eject the processing liquid in each of the plurality of times of scanning so that the processing liquid the ejection data of which is thinned at the predetermined ration ejected to each of a plurality of lines, when performing printing the plurality of lines of an image by making different ejection openings correspond to respective of the plurality of times of scanning in associating with relative moving of the printing head ejecting the ink to the printing medium.

The above and other objects, effects, features and advantages of the present invention will become more apparent foe the following description of embodiments thereof taken in conjunction with the accompanying drawings.

BRIEF DESCRIPTION OF THE DRAWINGS

FIGS. 12A to 12G are illustrations for explaining occurrence of color irregularity in the case where masks of the ink and the processing liquid are synchronized.

DESCRIPTION OF THE PREFERRED EMBODIMENT

The preferred embodiment of the present invention will be described hereinafter in detail with reference to the drawings.

Hereinafter, description will be given in terms of an example, in which, a multi-path printing is performed by using a printing ink and a processing liquid applied with thinning with respect to the ink as two kinds of liquids.

Figure 1:
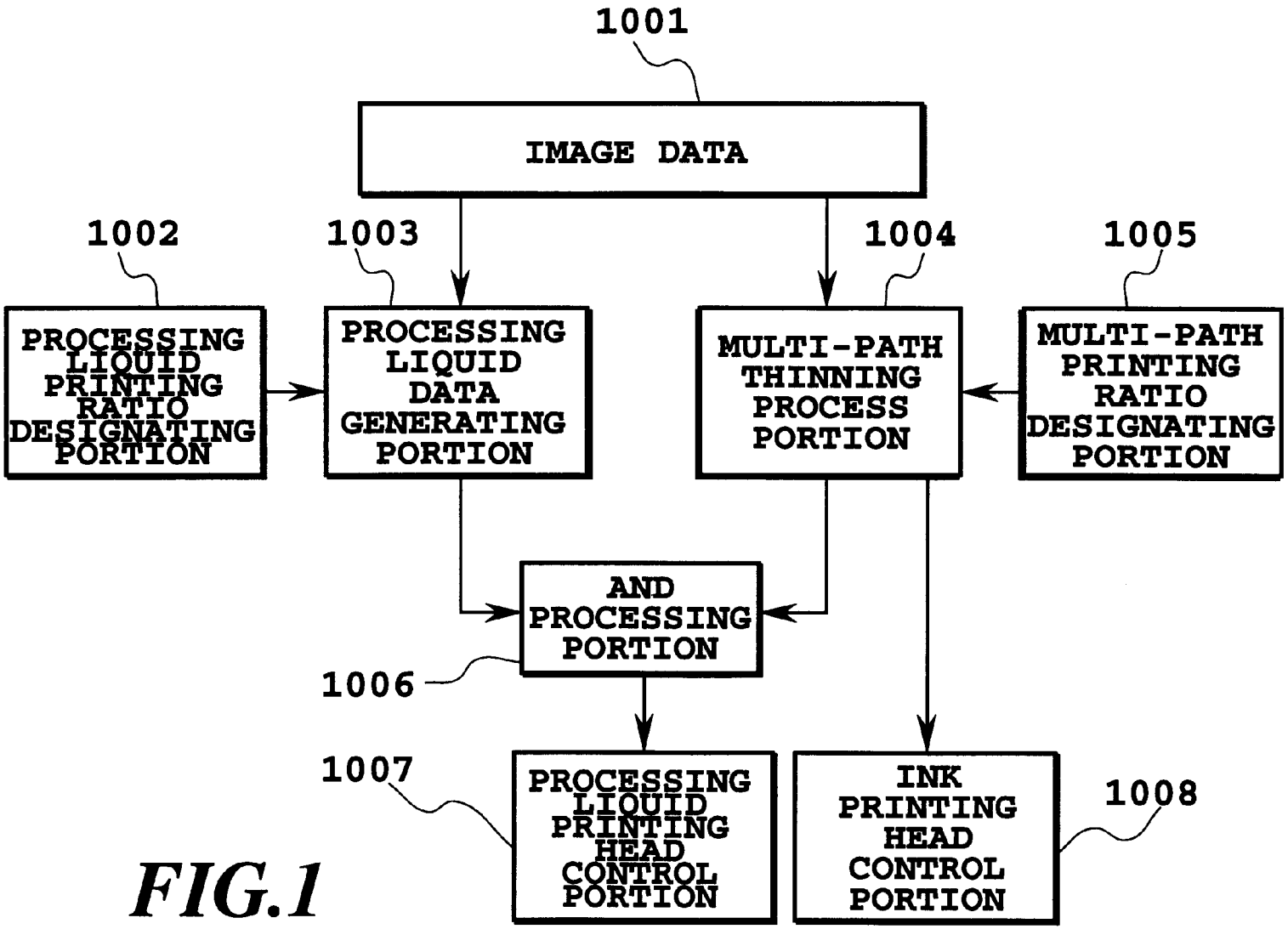
FIG. 1 is a block diagram showing a construction for generating ejection data of an ink and a processing liquid in the preferred embodiment of the present invention.

FIG. 1 is an illustration for explaining a process for generating an ejection data of a processing liquid and an ejection data of a printing ink from an image data.

An image data 1001 is a data of a bitmap format and is obtained through color processing and binarizing process. An ejection data of an ink transmitted to an ink printing head control portion 1008 is generated by a multi-path thinning process portion 1004 which performs thinning process for the image data 1001 according to a printing ratio designated by a multi-path printing ratio designating portion 1005. On the other hand, an ejection data of the processing liquid transmitted to a processing liquid printing head control portion 1007 is generated by performing an AND processing of a data generated by the processing liquid data generating portion 1003 which provides a process explained later for the image data 1001 according to a printing ratio designated by a processing liquid printing ratio designating portion 1002 and an ink ejection data generated the multi-path thinning process portion 1004 set forth above. The reason why the AND processing is performed, is to enable ejection of the processing liquid corresponding to ejection of the ink, in the same scan.

It should be noted that the printing ratio designated by the processing liquid printing ratio designating portion 1002 determines a final amount of the processing liquid applied to the image to be printed. Further, in the multi-path thinning process portion 1004 performs the thinning process according to SMS system set forth above as one kind of the multi-path systems.

Figure 2A:
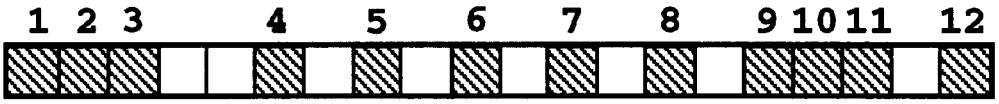
FIGS. 2A and 2B are illustrations for explaining a multi-path printing system in ink ejection in the preferred embodiment.
Figure 2B:
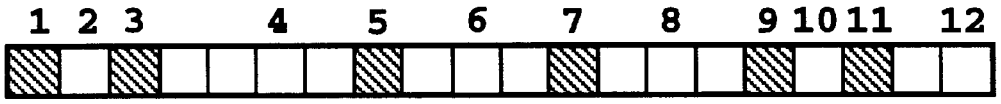

FIGS. 2A and 2B are illustrations for detailed explaining in detail the process by the multi-path thinning process portion 1004 shown in FIG. 1.

In the SMS system, with respect to the image data for one line (one row) which corresponds to one line of pixels, pixels to be printed is extracted for each image data of respective scans at a predetermined ratio with paying attention only for the pixels to be printed, excluding non-printed pixels. FIG. 2A is a diagrammatic illustration of the image data to be printed. For convenience of explanation, the pixels to be printed shown with hatching are given numbers in sequential order. Upon performing printing in the SMS system, thinning is performed so that the pixels given the odd numbers are printed in the first scan and the pixels given the even numbers are printed in the second scan. The data for the first scan obtaining through the thinning process set forth above is shown in FIG. 2B.

By implementing the SMS system as set forth above, the data is uniformly thinned to perform printing by dividing data for two scans, so that a plurality of ejection openings (two ejection openings in the shown case) are uniformly assigned for the pixels to be printed, and divided printing can be certainly performed. Thus, reduction of the density unevenness can be successfully achieved. In addition, local concentration of the use frequency of the ejection openings can be avoided to maximize the life of the printing head. Furthermore, number of ejection openings to perform ejection simultaneously can be reduced to permit reduction of capacity of a power source for the printing apparatus.

The printing ratio per one scan in the multi-path system depends on number of scans for completing the image, except for the case where two or more ink droplets of the same color are ejected on one pixel for gradation printing, enhancing printing and the like. Generally, in order to uniformly use the ejection openings, the same printing ratio is set for respective scan. For example, in two path mode to complete the image by two scans, the printing ratio may be ½, in three path mode to complete the image by three scans, the printing ratio may be ⅓, and thus, in n path mode to complete the image by n times of scans, the printing ratio in each scan may be 1/n.

Next, explanation will be given for thinning of ejection data for the processing liquid.

In the shown embodiment, when thinning for ink ejection is periodically performed for n pixels since the printing ratio for one scan in the multi-path system for ink ejection is periodically 1/n, the ejection data of the processing liquid is thinned for m which is a natural number and is a prime relative to n and the printing of the processing liquid based on thus obtained thinned ejection data is performed.

FIGS. 3A to 3I are illustrations for explaining an applying method of the processing liquid in the shown embodiment.

Figures 3A, 3B, 3C, 3D, 3E, 3F, 3G, 3H, 3I:
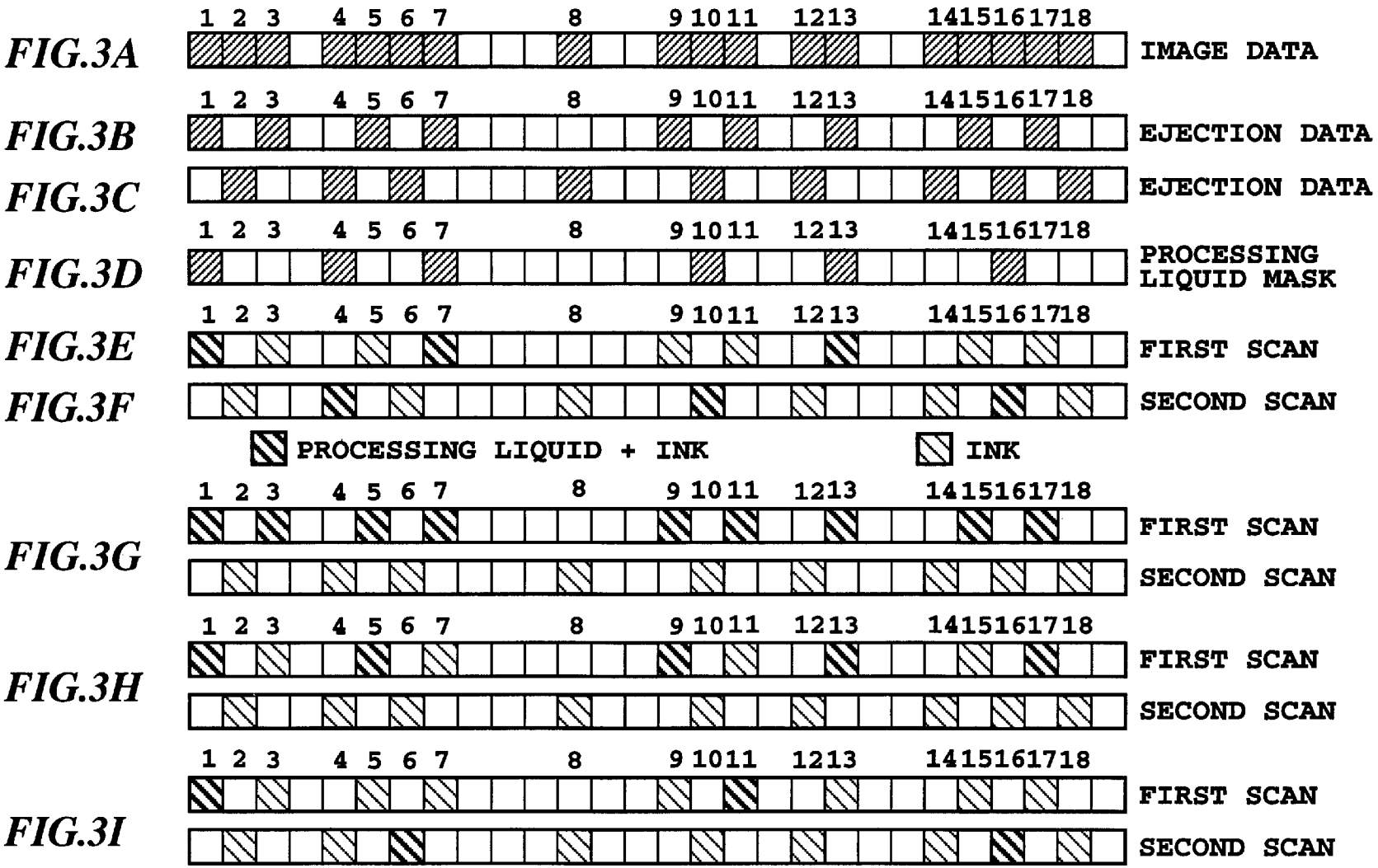
FIGS. 3A to 3I are explanatory illustrations for explaining two-path printing in the preferred embodiment.

FIG. 3A is an illustration diagrammatically showing data for one line of the image to be printed. In FIG. 3A, the pixels shown with hatching are the pixels, toward which the ink is to be ejected. For the purpose of explanation, number 1 to 18 are given for each of those pixels. In the case that the image data is used for printing of the printing ratio of ½ in the SMS system in which the printing is performed by twice of scanning, in the first scan, the data shown in FIG. 3B corresponding to the odd numbered pixels are used for printing and in the second scan, the data shown in FIG. 3C corresponding to the even numbered pixels are used for printing, respectively.

In the shown embodiment, with respect to the ink ejection data, the ejection data of the processing liquid is determined as shown is FIGS. 3D in which the processing liquid is periodically ejected for three dots relative to the ink dots. Namely, the processing liquid is applied to the hatched pixels in FIG. 3D are the pixels. In this case, after scanning twice, final application ratio of the processing liquid becomes 33% duty with respect to the image data.

Respective ejection data of the ink and the processing liquid are generated through the process explained with respect to FIG. 1. A result of printing in the first path is illustrated in FIG. 3E and a result of printing in the second path is illustrated in FIG. 3F, respectively. In respective path, the dots formed by the ink and the processing liquid and the dots formed by only ink are formed uniformly. Thus, the processing liquid is uniformly applied by twice scanning.

As set forth above, when the data for each line is printed by scanning twice, the processing liquid is uniformly applied for each path, and then, unevenness of order of application of the processing liquid for each scanning region can be avoided. As the result of this, difference of color development for the regions as set out with respect to FIG. 12F will never be caused to prevent stripe form the color irregularity or the density unevenness in the paper feeding direction.

Further, by uniformly performing ejection of the processing liquid in twice scanning for each line, fluctuation of the ejection characteristics of the ejection openings for processing liquid can be reduced. Also, number of ejection openings simultaneously ejecting the processing liquid can be reduced to lower maximum electrical power to be used.

In the foregoing embodiment set forth above, the effect of the present invention can be obtained by setting the period of thinning of the processing liquid to be three which is prime relative to two as the period of thinning in the multi-path for ejection of the ink. More specifically, FIGS. 3G, 3H and 3I show results of printing in the first scan and the second scan in respective cases where the printing ratios of the processing liquid are set at ½, ¼ and ⅕, respectively, in the case that printing is performed by ejecting the ink based on the data shown in FIGS. 3B and 3C which are the data for performing printing with twice scanning based on the image data shown in FIG. 3A. As can be clear from FIGS. 3G, 3H and 3I, in the case of five dot period (⅕ of the printing ratio) shown in FIG. 3I, the processing liquid is dividingly ejected for twice scanning. In contrast to this, in the case of two dots period (½ of the printing ratio) and four dots period (¼ of the printing ratio) shown in FIGS. 3G and 3H, respectively, the processing liquid to be applied finally are all applied in the first scan.

In this case, as explained with respect to FIG. 12F, printing of the second scan shown in FIGS. 3G and 3H is performed at earlier timing in certain scanning region. As a result, the stripe of color irregularity or the density unevenness may be caused. Also, number of ejection openings of the processing liquid simultaneously ejecting becomes the same as that in case of one path printing to increase power consumption.

Thus, for two dots period for the multi-path printing in ink ejection, a predetermined effect can be obtained by setting the five dots period for applying the processing liquid which is prime to the two dot periods of ink ejection, whereas the effect may not be obtained in two dots period and four dots period which are not prime to the two dots period of ink ejection.

It should be noted that, while the printing ratio of the processing liquid is set at 1/m in the foregoing example, numerator is not necessarily one. For example, even when the printing ratio of the processing liquid is set at ⅔, namely, the processing liquid mask by which the processing liquid is applied to the pixels 1, 2, pixels 4, 5 in FIGS. 3B and 3C, application of the processing liquid has three dots period and then the equivalent effect can be achieved.

Further, in the foregoing embodiment, while discussion is given for the two dots period of SMS system in ink ejection, namely, for the case where one line is printed by two path, the present invention is applicable for printing in three path or four path. In the case of three paths, assuming the final printing ratio is 100% (when each printing pixel is printed by one ink droplet), the printing ratio for ink ejection generally becomes ⅓ for each scan. In this case, as the printing ratio for the processing liquid, the ratio of ½, ¼, ¾ and so on can be set and then the period becomes prime to that for ink ejection. Similarly, when for ink ejection is set at ¼ for four path scanning, the printing ratio of the processing liquid at ⅓, ⅔, ⅕ and so on are effective.

In addition, it is further effective to designate the individual different printing ratio of the processing liquid for respective ejection openings as proposed in Japanese Patent Application No. 316117/1996 set forth above. For example, when the SMS printing mode of two paths is executed, in which the necessary minimum printing ratio of the processing liquid for improving printing ability is 50% depending upon a combination of properties and ejection amounts of the ink and the processing liquid, even if the printing ratio of the processing liquid is simply set at ½, the problem as set forth above is inherently caused while the ratio of 50% can be achieved. In contrast to this, by setting the printing ratio of the processing liquid in the ejection openings of even numbers in the sequential order at ⅓ and the printing ratio of the processing liquid in the ejection openings of odd numbers in the sequential order at ⅔, the printing duty (the printing ratio) of the processing liquid in total becomes 50% with avoiding synchronization with the period for ink ejection in the multi-path. Thus, the effect of the present invention can be achieved. It should be noted that while an example stated above has been explained in terms of the case where the ejection openings are divided into two groups of the odd number and the even number, a manner of division of the ejection openings is not specified to that set forth above. For instance, the ejection openings may be divided into three groups or more.

In addition, the foregoing examples are explained for the cases where printing is performed finally at 100% duty in ink ejection. However, by varying the printing ratio (an application ratio of ink) for one scan in the multi-path printing, gradation printing, enhancing printing or thinning printing can be realized. Even in such cases, a manner of determining the application ratio of the processing liquid is the same as the former examples. With respect to this embodiment, explanation will be given for the case where the ink is applied with the printing ratio of 67% (⅔) duty for one scan in the SMS printing of two paths.

Figures 4A, 4B, 4C, 4D, 4E, 4F:
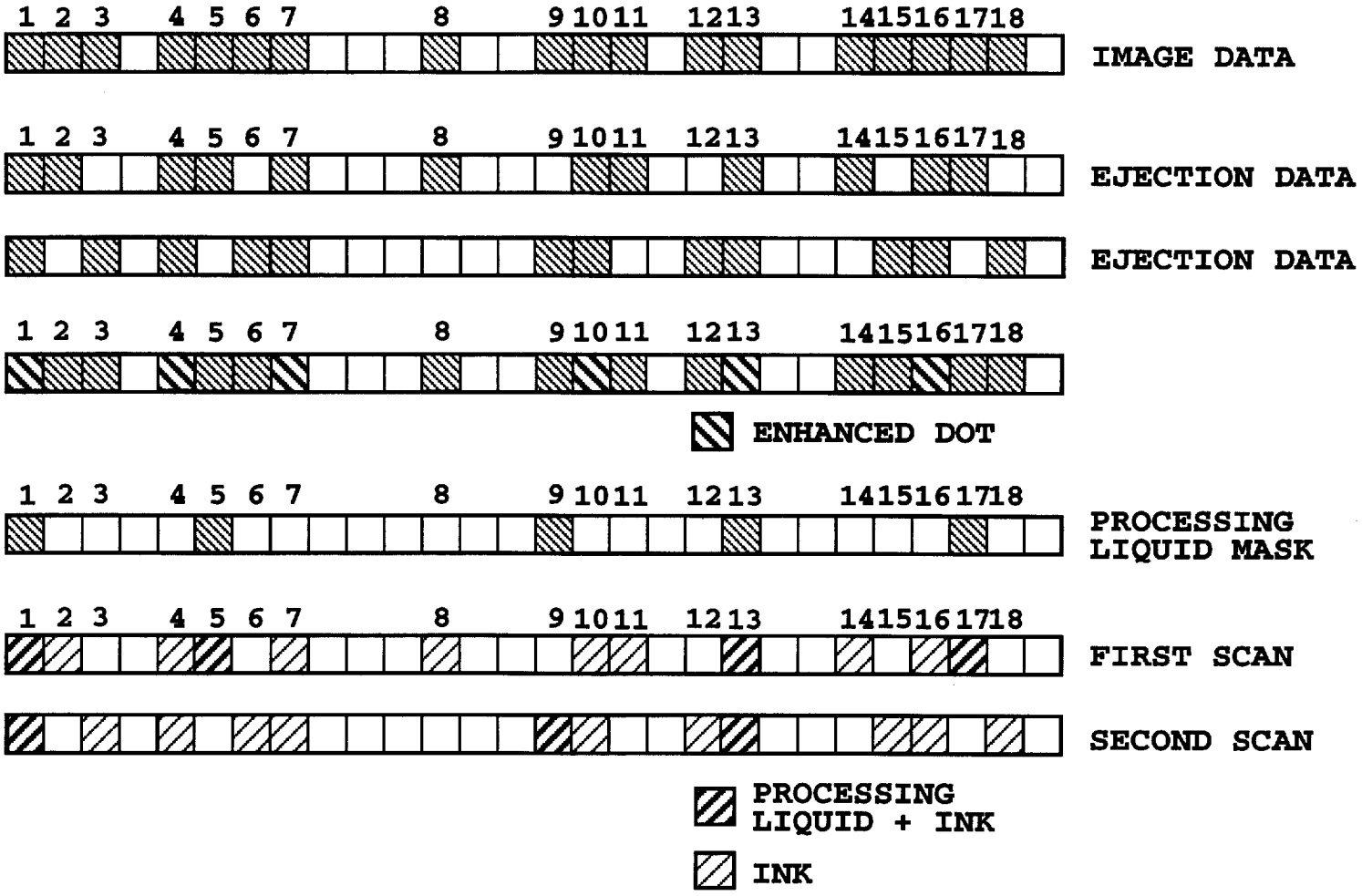
FIG. 4A to 4F are explanatory illustrations for explaining two-path enhancing printing in the preferred embodiment.

FIG. 4A shows image data expressed as pixel data, in which the pixels shown with hatching are pixels to be printed. The shown image data is thinned into ⅔ using the SMS system set forth above and used for printing by scanning twice, and then the ejection data for the first scan becomes data shown in FIG. 4B and the ejection data for the second scan becomes data shown in FIG. 4C, respectively. Finally, as shown in FIG. 4D, by combining a dot, which is formed on one pixel by ejecting once, and an enhanced dot which is formed on one pixel by ejecting twice, the enhanced printing of 133% duty can be performed. In this case, the period of printing of the ink is three dots period.

On the other hand, the printing of the processing liquid may be set at a period of natural number prime to three as the period of printing of the ink. For example, ¼ can be taken as the printing ratio of the processing liquid. In this case, the mask for the processing liquid as shown in FIG. 4E can be used, and then, in the result of printing, the processing liquid can be uniformly divided to the first scan and the second scan, as shown in FIG. 4F. As the printing ratio of the processing liquid, in addition to the foregoing printing ratio, ½, 3/4 and so on can be taken. In any case, the processing liquid may be applied in a period prime to three as the period for the multi-path for ink ejection. The same manner may be taken even for the case where the processing liquid is applied for the finally thinned ink printing image.

More specifically, it is enough to select the printing ratio m of the processing liquid so that m is prime to the period n in application of the printing ink in one scan, and the processing liquid is applied at the period m. Further, the application amount of the printing ink in one scan is determined based on the ink amount to be applied finally and number of scan.

In the embodiment set forth above, the thinning process has been performed by the multi-path processing portion and the processing liquid generating portion formed in the printing apparatus. However, a method to transfer a data processed by the thinning process by means of a host computer or the like to the printing apparatus, may also be employed. More specially, the host computer may have the elements 1001 to 1006 in FIG. 1 to generate, the thinned data through thinning process and to transfer to a printer.

Further, while the foregoing embodiments have been explained for the case where the printing data is thinned cyclically in the scanning direction of the printing head, it is also possible to effect thinning in the auxiliary scanning direction as paper feeding direction by mounting a memory for the image data. Even in this case, the thinning period of the multi-path and the thinning period of the processing liquid should be set to be prime to each other.

Other Embodiment

In the foregoing embodiments, the case employing the SMS system has been disclosed as one example of the multi-path system in ink ejection. According to the embodiments, the period for thinning in ink ejection and the period for thinning in the processing liquid are set at prime to each other, and then application of the processing liquid can be uniformly distributed in a plurality of times of scanning for printing one line to achieve effect of prevention of color irregularity and so on. However, even through application of the processing liquid is not uniform, effect of the present invention can be nevertheless achieved in certain extent as long as application of the processing liquid can be distributed for a plurality of times of scanning.

Figures 5A, 5B, 5C, 5D:
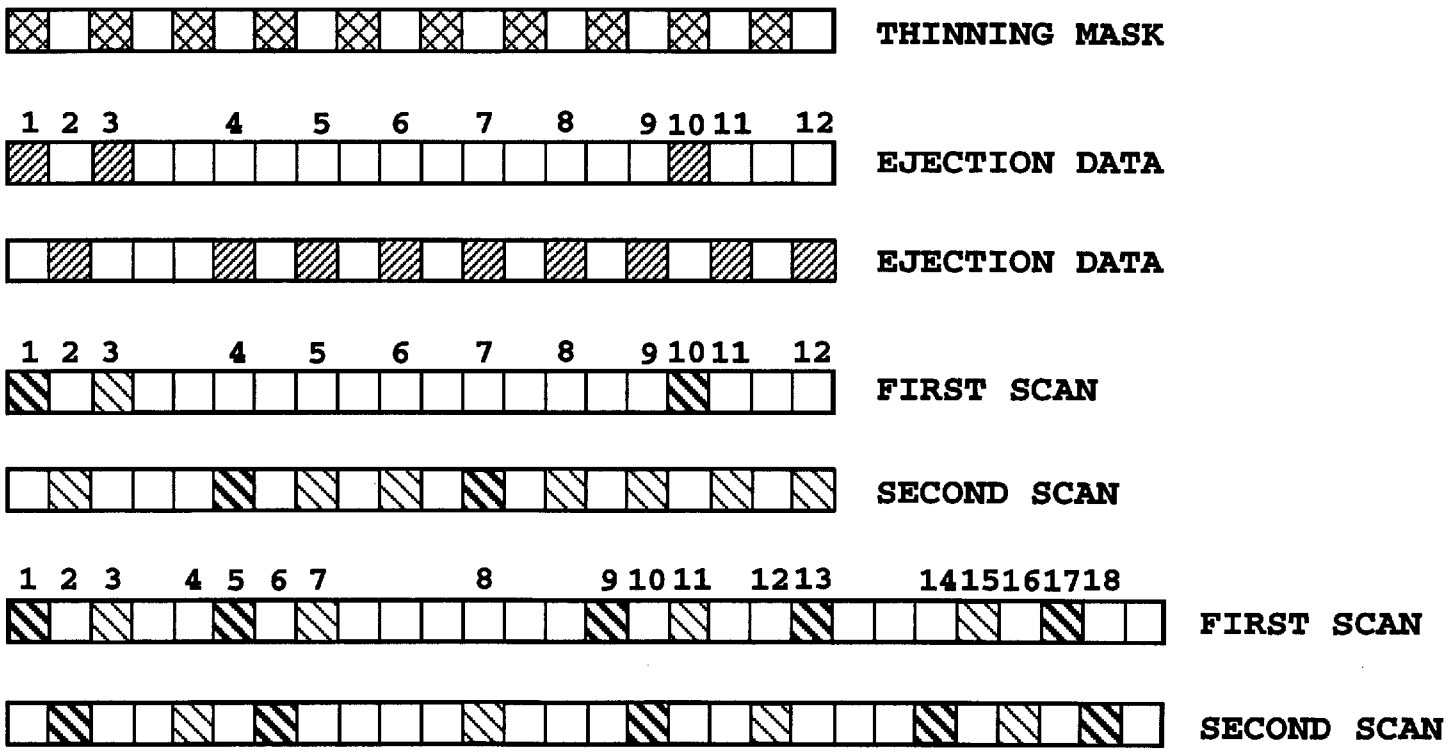
FIGS. 5A to 5D are explanatory illustrations for explaining two-path printing in another embodiment.

FIGS. 5A to 5C show one example of this case. As one example of the multi-path system in ink ejection, a fixed mask shown in FIG. 5A is used. For example, when this mask is employed for the image data shown in FIG. 2A, the ink ejection data of each scan shown in FIG. 5B can be obtained. For this data, similarly to the foregoing embodiments, application of the processing liquid is performed with taking ⅓ (three period) of the printing ratio of the processing liquid. Then, a result of printing, in which application of the processing liquid is distributed for scanning twice, can be obtained as shown in FIG. 5C. FIG. 5D is an illustration showing anther example, in which respective result of printing in scanning twice as setting the printing ratio of the processing liquid at ¾ in the example explained with reference to FIG. 3.

More specifically, in the example shown in FIGS. 5A to 5D, the period for the SMS system is two, and the period for the processing liquid is four which is not prime to the period two of the ink ejection. However, application of the processing liquid can be distributed to two scannings.

Figure 6:
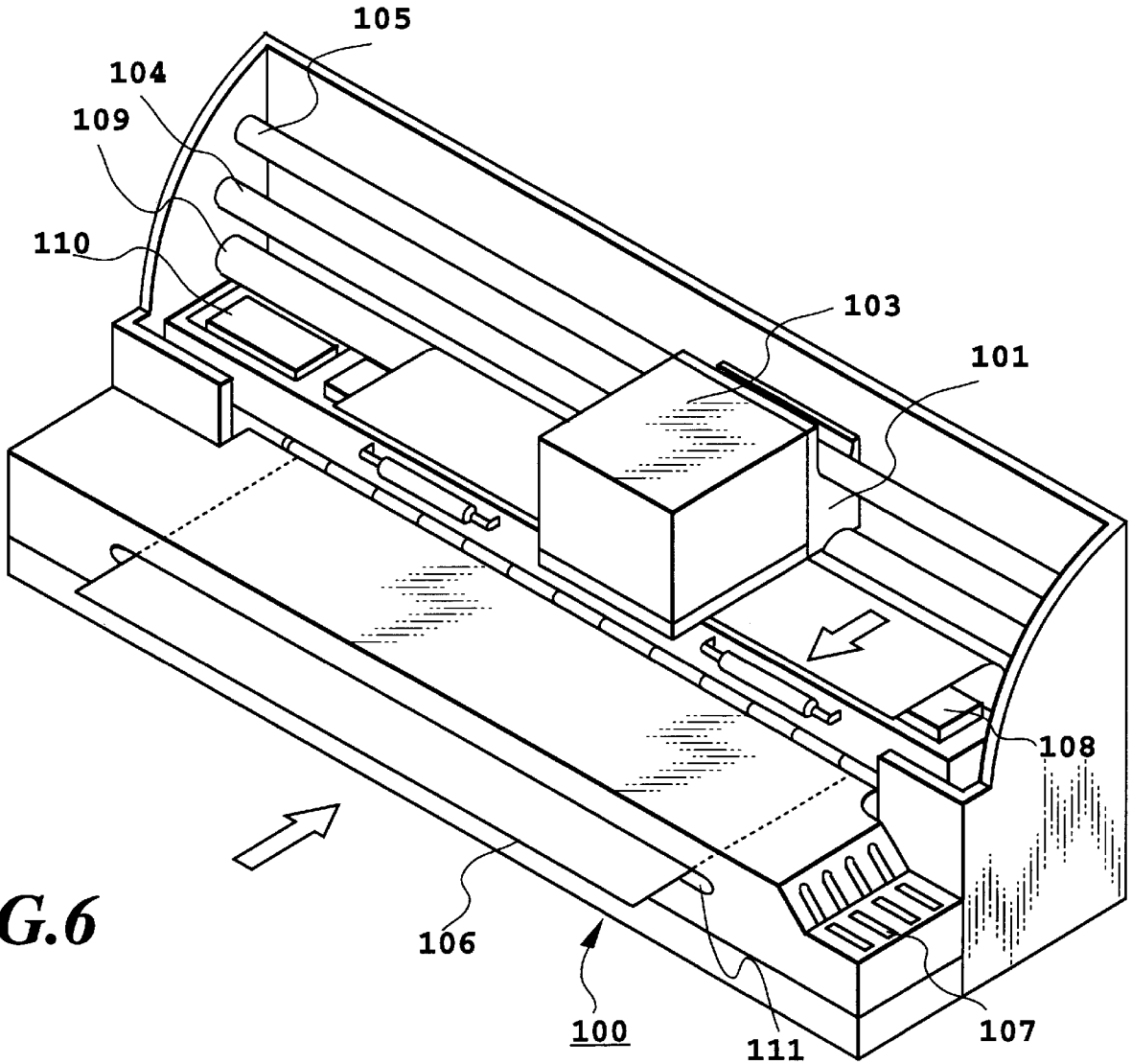
FIG. 6 is a perspective view showing one example of an ink-jet printing apparatus, to which the present invention is applicable.

FIG. 6 is a general perspective view showing one embodiment of the ink-jet printing apparatus, to which is the present invention is applicable.

A printing medium 106 inserted into a paper feeding position of a printing apparatus 100 is transported to a printable region of a printing head unit 103 by a feeding roller 109. On a lower portion of the printing medium in a printable region, a platen 108 is provided. A carriage 101 is constructed for movement in a direction determined by two guide shafts consisted of a guide shaft a 104 and a guide shaft b 105 for reciprocally scanning the printing region. On the carriage 101, a printing head unit 103 mounting printing heads ejecting a plurality of color inks and the processing liquid and ink tanks storing and supplying inks and the processing liquid to respective printing heads, is loaded. A plurality of color inks provided in this embodiment of the ink-jet printing apparatus, are four color inks of black (Bk), cyan (C), magenta (M) and yellow (Y).

Here, as an example, the processing liquid or solution for making ink dyestuff insoluble can be obtained in the following manner.

Specifically, after the following components are mixed together and dissolved, and the mixture is pressure-filtered by using a membrane filter of 0.22 μm in pore size (tradename: fuloropore filter manufactured by Sumitomo Electric Industries, Ltd.), and thereafter, pH of the mixture is adjusted to a level of 4.8 by adding sodium hydroxide whereby liquid A1 can be obtained.

[components of A1]

| | |
|---|---|
| low molecular weight ingredients of cationic compound; stearyl-trimethyl ammonium salts (tradename: Electrostriper QE, manufactured by Kao Corporation), or stearyl-trimethyl ammonium chloride (tradename: Yutamine 86P, manufactured by Kao Corporation) | 2.0 parts by weight |
| high molecular weight ingredients of cationic compound; copolymer of diarylamine hydrochloride and sulfur dioxide (having an average molecular weight of 5000) (tradename: polyaminesulfon PAS-92, manufactured by Nitto Boseki Co., Ltd) | 3.0 parts by weight |
| thiodiglycol; | 10 parts by weight |
| water | balance |

Preferable examples of ink which becomes insoluble by mixing the aforementioned processing liquid can be noted below.

Specifically, the following components are mixed together, the resultant mixture is pressure-filtered with the use of a membrane filter of 0.22 μm in pore size (tradename: Fuloroporefilter, manufactured by Sumitomo Electric Industries, Ltd.) so that yellow ink Y1, magenta ink M1, cyan ink C1 and black ink K1 can be obtained.

[Yellow ink Y1]

| | |
|---|---|
| C.I. direct yellow 142 | 2 parts by weight |
| thiodiglycol | 10 parts by weight |
| acetynol EH (tradename manufactured by Kawaken Fine Chemical Co., Ltd.) | 0.05 parts by weight |
| water | balance |

[Magenta ink M1]

having the same composition as that of Y1 other than that the dyestuff is changed to 2.5 parts by weight of C. I. acid red 289.

[Cyan ink C1]

having the same composition as that of Y1 other than that the dyestuff is changed to 2.5 parts by weight of acid blue 9.

[Blak ink K1]

having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

Referring again to FIG. 6, on the left end of a region where the carriage is movable, a recovery system unit 110 is provided on a lower portion. The recovery system unit 110 includes a cap for capping ejection opening portion of the printing head during non-printing, and so on. A left end position will be referred to as a home position of the printing head.

A reference numeral 107 denotes an operating portion consisted of switches, display elements and the like. The switches are used for turning ON/OFF of a power source of the printing apparatus, setting of various printing modes and so on. The display element portion serves for displaying a condition of the printing apparatus, and so on.

Figure 7:
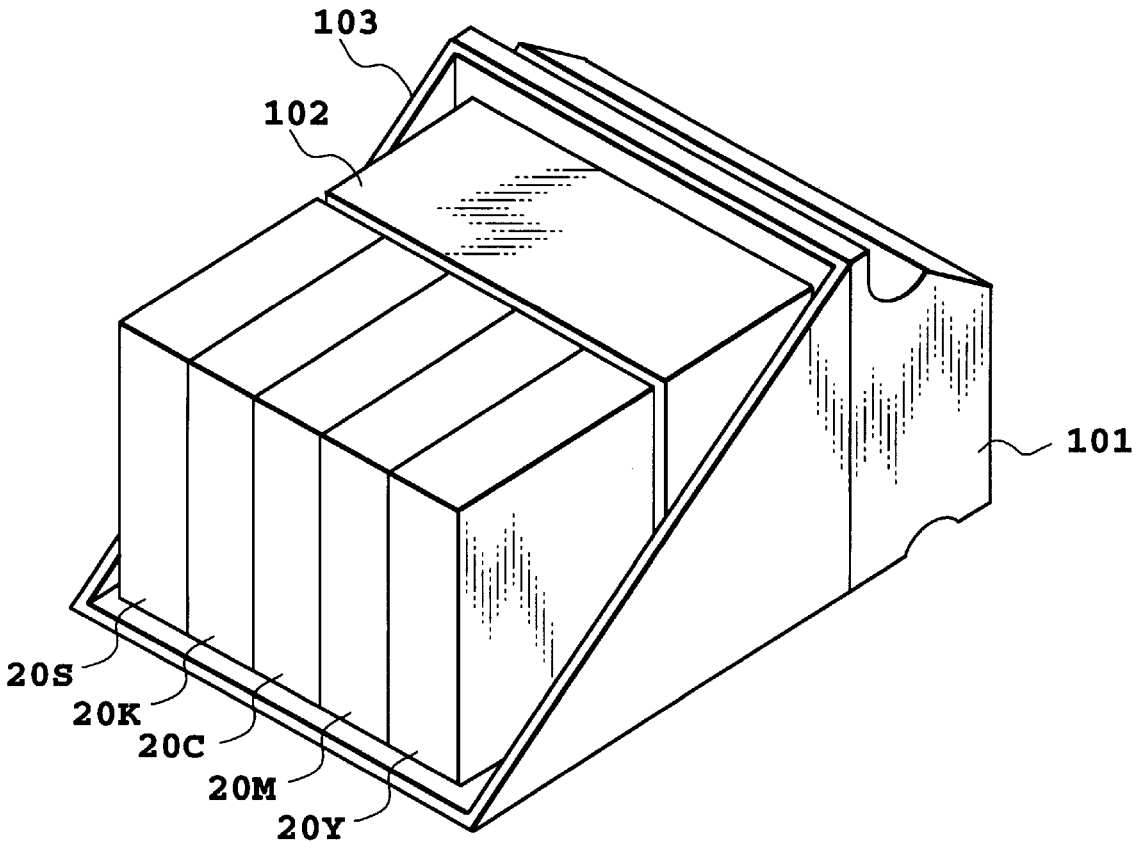
FIG. 7 is a perspective view showing a printing head unit to be employed in the ink-jet printing apparatus.

FIG. 7 is a perspective view showing the foregoing printing head unit 103. In the shown embodiment, tanks of respective colors of black, cyan, magenta and yellow and the processing liquid can be exchanged independently.

On the carriage 101, respective printing heads ejecting Bk, C, M and Y and the processing liquid, a tank 20K for Bk ink, a tank 20C for C ink, a tank 20M for M ink, a tank 20Y for Y ink and a tank 20S for the processing liquid are mounted. Each tank is connected to the printing head via a connecting portion with the printing head for supplying the ink or the processing liquid to the ejection openings.

Other than the foregoing example, the tanks of the processing liquid and the Bk ink may be integrated with each other, and the tanks for C, M, Y inks may also be integrated, for example.

Figure 8:
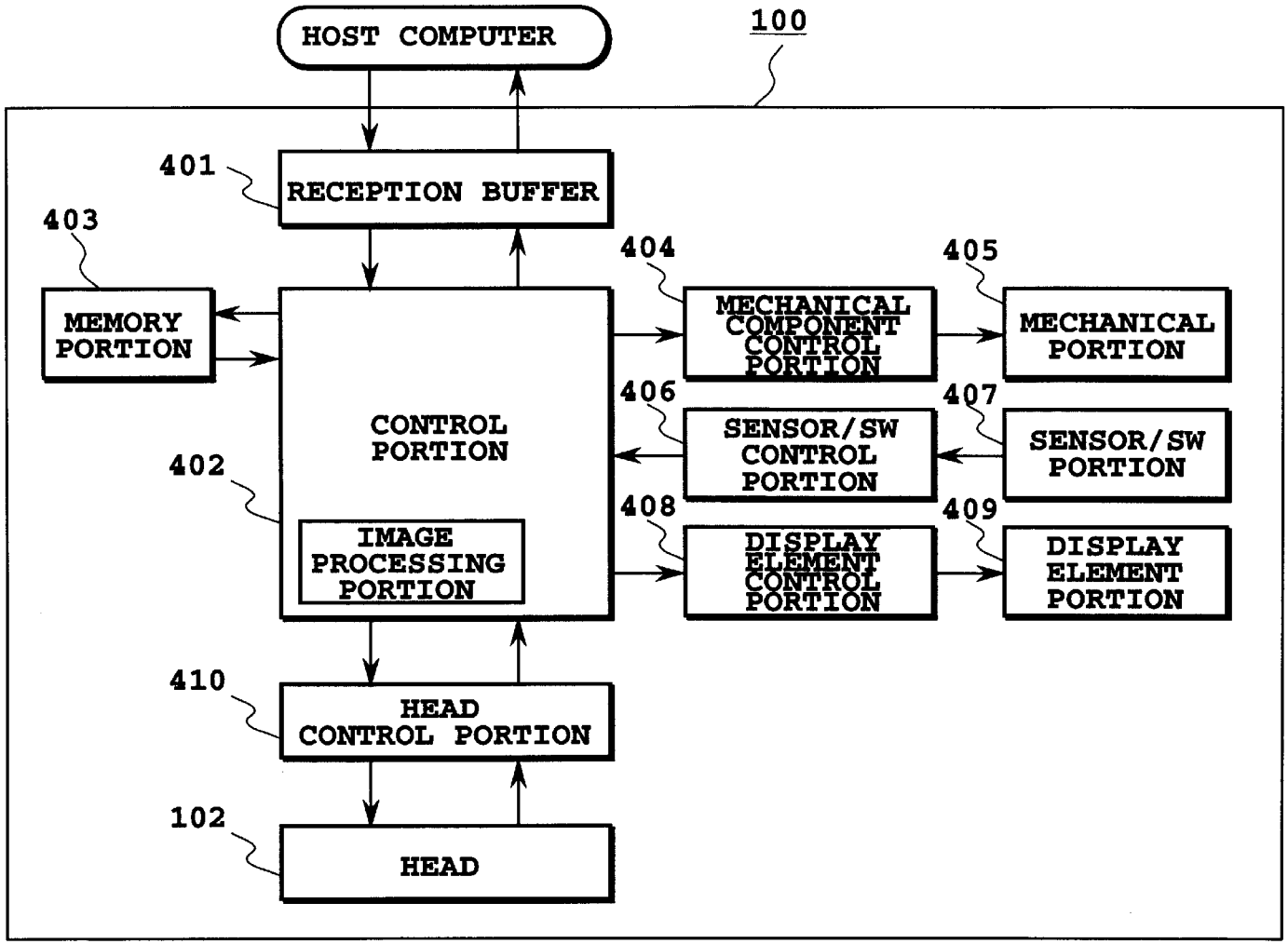
FIG. 8 is a block diagram showing a construction of a control system in the ink-jet printing apparatus.
Figure 9C:
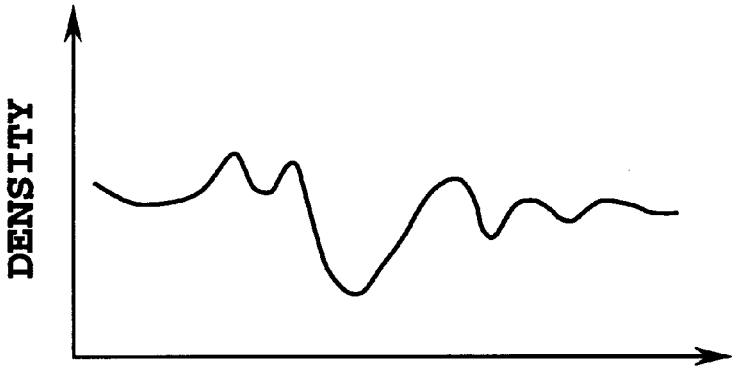
FIGS. 9A to 9C are illustrations for explaining a cause of density unevenness.
Figure 9B:
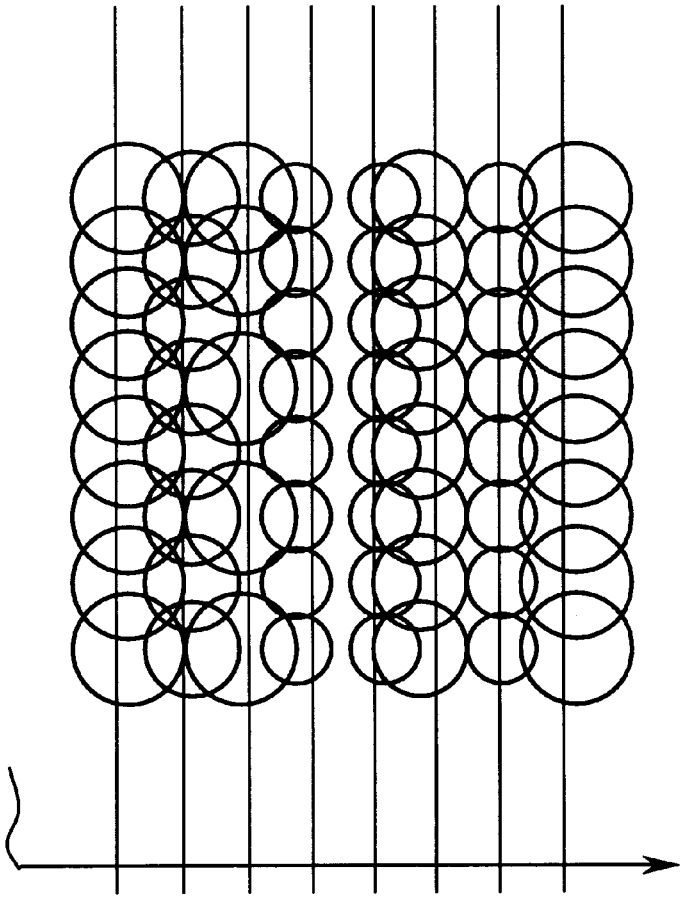
Figure 9A:
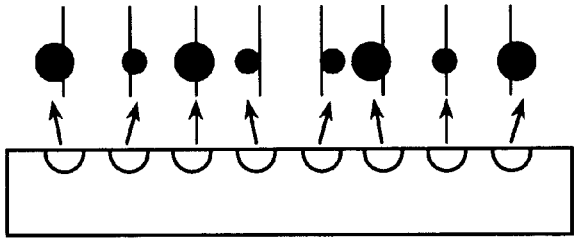
Figures 10A, 10B, 10C:
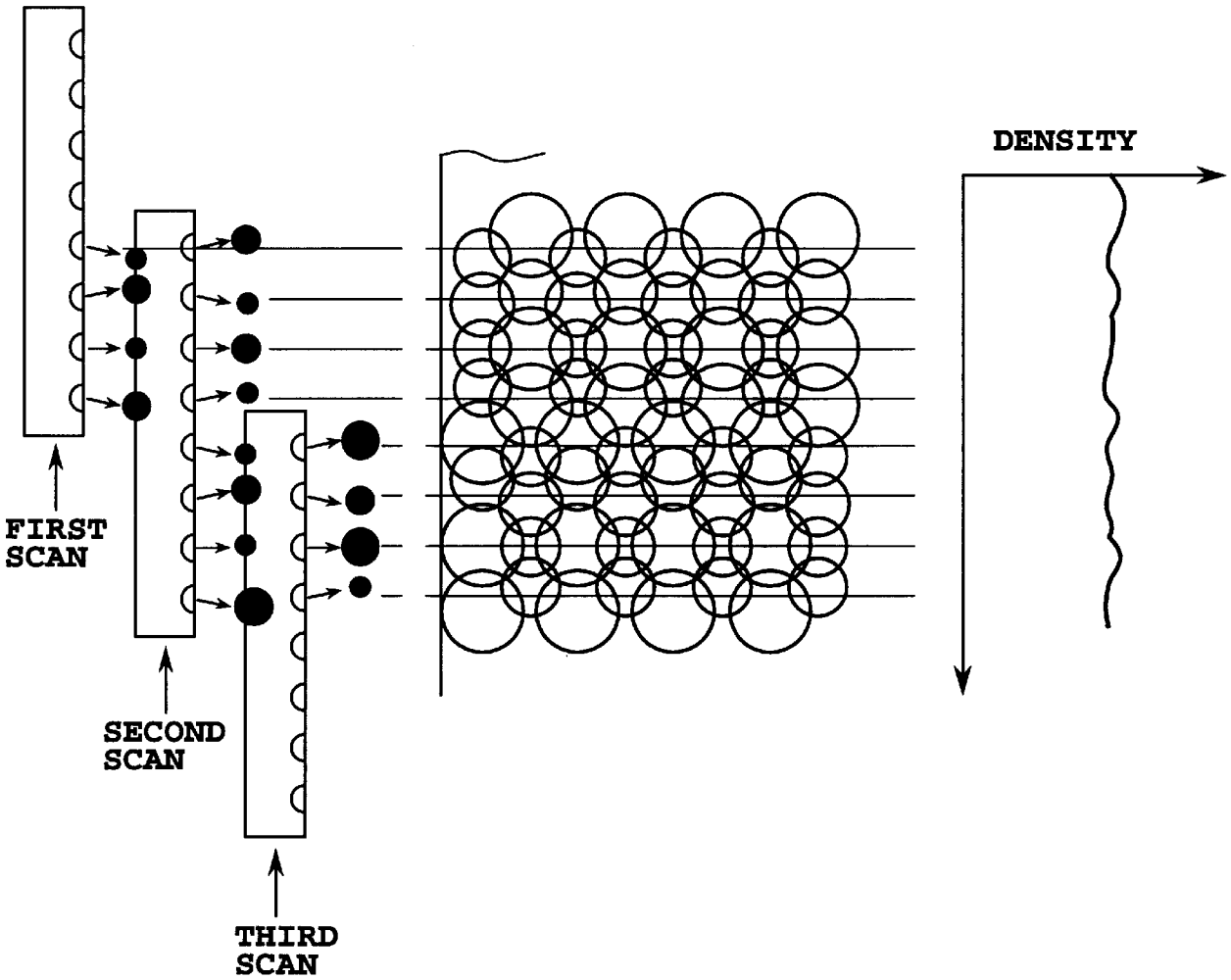
FIGS. 10A to 10C are illustrations for explaining an effect of reduction of the density unevenness by using multi-path printing.
Figures 11A, 11B, 11C:
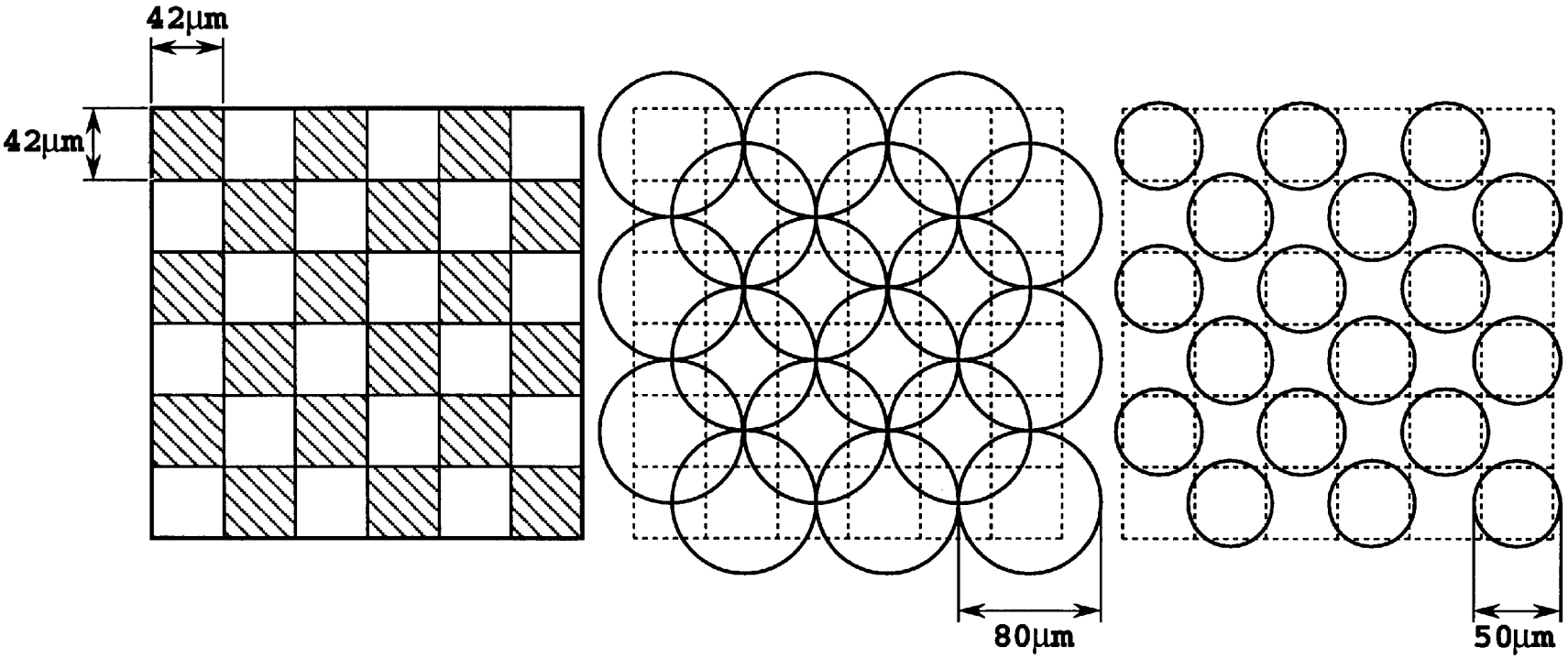
FIGS. 11A to 11C are illustrations for explaining spreading of a processing liquid dot on a surface of a printing medium.

FIG. 8 is a block diagram showing a construction of a control system of the foregoing ink-jet printing apparatus. Data of character or graphic image to be printed (hereinafter referred to as image data) is input to a reception buffer 401 of the printing apparatus from a host computer. Further, a verification data for verifying whether a correct data is transferred or not and data notifying operating condition of the printing apparatus are returned from the printing apparatus to the host computer. Data stored in the reception buffer 401 is transferred to a memory portion 403 under management of a control portion 402 and temporarily stored in RAM (random-access-memory). A mechanical component control portion 404 drives a mechanical portion 405 consisted of carriage motor, line feeding motor and the like, by a command from the control portion 402. A sensor/SW control portion 406 feeds signals from sensor/SW portion 407 consisted of various sensors and SW's (switches) to the control portion 402. A display element control portion 408 controls a display element portion 409 consisted of LED of a display panel group, liquid crystal elements and the like by a command from CPU. A printing head control portion 410 controls a printing head 411 by a command from CPU. Further, a temperature information and the like are sensed indicating the condition of the printing head 411 is transferred to the control portion 402. Also, the control portion 402 includes CPU and forms respective portions shown in FIG. 1.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average molecular weight of 6000, neutralizing agent potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

(Composition of carbon black dispersing element)

| | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylen-acrlylic acid methyl methaacrylate having an acid value of 280 and an average molecular weight of 11,000, neutralizing agent:diethanolamine) is used as a dispersing agent and dispersive treatment is conducted in the same manner as production of the black ink K2 whereby yellow color dispersing element having a weight-average grain size of 103 nm is produced.

(composition of yellow dispersing element)

| | |
|---|---|
| P-2 aqueous solution (having a solid ingredient of 20%) | 35 parts |
| C.I. pigment yellow 180 (tradename: Nobapalm yellow PH-G, manufactured by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10 %.

[Cyan ink C2]

Cyan colored-dispersant element having a weight-average grain size of 120 nm is produced by using the anionic high molecular P-1 used when producing the black ink K2 as dispersing agent, and moreover, using the following materials by conducting dispersing treatment in the same manner as the carbon black dispersing element.

(composition of cyan colored-dispersing element)

| | |
|---|---|
| P-1 aqueous solution (having solid ingredient of 20%) | 30 parts |
| C.I. pigment blue 153 (tradename: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

(composition of the magenta colored dispersing element)

| | |
|---|---|
| P-1 aqueous solution (having solid ingredient of 20%) | 20 parts |
| C.I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

The present invention achieves distinct effect when applied to a recording head or a recording apparatus which has means for generating thermal energy such as electro-thermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As set forth above, by the embodiments of the present invention, in case of performing printing by the ink and the processing liquid as thinned at the predetermined ratio relative of the ink, printing of a plurality of lines is performed corresponding to different ejection openings at respective of a plurality of times of scan by the printing head ejecting the ink. The processing liquid is ejected in each of a plurality of times of scanning in each line to eliminate the unevenness of order of overlaying of the processing liquid and the ink in each line.

As a result, the color irregularity or the density unevenness to be caused by difference of order of overlaying can be prevented. Further, for the ejection openings ejecting the processing liquid, increasing of amount of simultaneous ejection can be prevented to effectively perform high quality printing.

The present invention has been described in detail with respect to preferred embodiment, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. An ink-jet printing apparatus for performing printing on a printing medium by using a printing head having a plurality of ejection openings for ejecting an ink and printing head having a plurality of ejection openings for ejecting the processing liquid so as to eject the ink and the processing liquid ejection data of which is thinned at a predetermined ratio with respect to ejection data of the ink, comprising:

ink head control means for scanning the printing head for a plurality of times on the printing medium, and performing printing of a plurality of lines of an image by making to different ejection openings correspond to respective of said plurality of times of scanning; and processing liquid head control means for controlling the printing head ejecting the processing liquid to eject the processing liquid, said processing liquid head control means making said printing head eject said processing liquid in each of said plurality of times of scanning in the printing performed by said ink head control means so that said processing liquid the ejection data of which is thinned at the predetermined ratio is ejected to each of the plurality of lines.

2. An ink-jet printing apparatus as claimed in claim 1, wherein said ink head control means performs printing with assigning pixels to be printed of said plurality of lines of the image to the plurality of times of scanning at a period of n pixels, and said processing liquid head control means makes the printing head eject the processing liquid at a period of m pixels with respect to said pixels to be printed of said plurality of lines of the image, in which n and m are natural numbers and prime to each other.

3. An ink-jet printing apparatus as claimed in claim 2, wherein said processing liquid head control means makes the different ejection openings of the printing head ejecting the processing liquid correspond to respective of the plurality of times of scanning and makes said printing head eject the processing liquid.

4. An ink-jet printing apparatus as claimed in claim 3, wherein the processing liquid is a liquid making a coloring agent of said ink insoluble or coagulated.

5. An ink-jet printing apparatus as claimed in claim 4, wherein the printing head ejecting the ink and the printing head ejecting the processing liquid generate bubbles in the ink and the processing liquid by utilizing a thermal energy to eject said ink and said processing liquid by a pressure of said bubbles, respectively.

6. An ink-jet printing apparatus for performing printing on a printing medium by using a printing head having a plurality of ejection openings for ejecting an ink and printing head having a plurality of ejection openings for ejecting the processing liquid so as to eject the ink and the processing liquid ejection data of which is thinned at a predetermined ratio with respect to ejection data of the ink, comprising:

control means for making the printing head ejecting the processing liquid eject the processing liquid in each of the plurality of times of scanning so that said processing liquid the ejection data of which is thinned at the predetermined ratio is ejected to each of a plurality of lines, when performing printing the plurality of lines of an image by making different ejection openings correspond to respective of said plurality of times of scanning in associating with relative moving of the printing head ejecting said ink to the printing medium; and reception means for receiving respective ejection data for respective of the printing head ejecting the ink and the printing head ejecting the processing liquid, which are made eject the ink and the processing liquid by said control means, respectively, from a host unit.

7. An ink-jet printing apparatus as claimed in claim 6, wherein number of ejection in respective of the plurality of times of scanning by said printing head ejecting the processing liquid is substantially the same.

8. An ink-jet printing apparatus as claimed in claim 6, wherein printing is performed with assigning pixels to be printed of said plurality of lines of the image to the plurality of times of scanning at a period of n pixels, and ejection of the processing liquid is performed at a period of m pixels with respect to said pixels to be printed of said plurality of lines of the image, in which n and m are natural numbers and prime to each other.

9. An ink-jet printing apparatus as claimed in claim 8, wherein the different ejection openings of the printing head ejecting the processing liquid are made correspond to respective of the plurality of times of scanning and said printing head is made eject the processing liquid.

10. An ink-jet printing apparatus as claimed in claim 8, wherein the processing liquid is a liquid making a coloring agent of said ink insoluble or coagulated.

11. An ink-jet printing apparatus as claimed in claim 4, wherein the printing head ejecting the ink and the printing head ejecting the processing liquid generate bubbles in the ink and the processing liquid by utilizing a thermal energy to eject said ink and said processing liquid by a pressure of said bubble.

12. An ink-jet printing method for performing printing on a printing medium by using a printing head having a plurality of ejection openings for ejecting an ink and printing head having a plurality of ejection openings for ejecting the processing liquid so as to eject the ink and the processing liquid ejection data of which is thinned at a predetermined ratio with respect to ejection data of the ink, comprising the step of:

making the printing head ejecting the processing liquid eject the processing liquid in each of the plurality of times of scanning so that said processing liquid the ejection data of which is thinned at the predetermined ration ejected to each of a plurality of lines, when performing printing the plurality of lines of an image by making different ejection openings correspond to respective of said plurality of times of scanning in associating with relative moving of the printing head ejecting said ink to the printing medium.

13. An ink-jet printing method as claimed in claim 12, wherein number of ejection in respective of the plurality of times of scanning by said printing head ejecting the processing liquid is substantially the same.

14. An ink-jet printing method as claimed in claim 12, wherein printing is performed with assigning pixels to be printed of said plurality of lines of the image to the plurality of times of scanning at a period of n pixels, and ejection of the processing liquid is performed at a period of m pixels with respect to said pixels to be printed of said plurality of lines of the image, in which n and m are natural numbers and prime to each other.

15. An ink-jet printing method as claimed in claim 14, wherein the different ejection openings of the printing head ejecting the processing liquid are made correspond to respective of the plurality of times of scanning and said printing head is made eject the processing liquid.

16. An ink-jet printing method as claimed in claim 15, wherein the processing liquid is a liquid making a coloring agent of said ink insoluble or coagulated.

* * * * *

UNITED STATES PATENT AND TRADEMARK OFFICE

CERTIFICATE OF CORRECTION

PATENT NO. : 6,135,656
DATED : October 24, 2000
INVENTOR(S) : Minako Kato et al.

It is certified that error appears in the above-identified patent and that said Letters Patent is hereby corrected as shown below:

Title page, item [57]
Line 2, "distributed" should read -- distributing --;
Line 10, "differentiate order" should read -- differentiated the order --.

Column 1,
Line 30, "of" should be deleted;
Line 36, "provided" should read -- providing --;
Line 40, "as a nature," should be deleted and "solve" should read -- dissolve --;
Line 44, "a" should read -- The --; and
Line 45, "complicate." should read -- complicated. --.

Column 2,
Line 26, "to" should be changed to -- The --.

Column 3,
Line 9, "is" should read -- are --;
Line 10, "consisted" should read -- consisting --;
Line 13, "group correspond" should read -- groups correspond to --;
Line 18, "use" should read -- used --; and
Line 27, "method" should read -- methods --.

Column 4,
Line 19, "without no" should read -- without any --; and
Line 42, "consisted" should read -- consisting --.

Column 5,
Line 27, "sequent" should read -- sequence --; and
Line 51, "region." should read -- the region. --.

Column 6,
Line 38, "liquid ejection" should read -- liquid the ejection --;
Line 43, "to" (1st occurrence) should read -- the -- and "correspond" should read -- correspond respectively --;
Line 44, "respective of" should be deleted; and
Line 61, "liquid ejection" should read -- liquid the ejection --.

UNITED STATES PATENT AND TRADEMARK OFFICE

CERTIFICATE OF CORRECTION

PATENT NO. : 6,135,656
DATED : October 24, 2000
INVENTOR(S) : Minako Kato et al.

It is certified that error appears in the above-identified patent and that said Letters Patent is hereby corrected as shown below:

Column 7,
Line 3, "to respective of the" should read -- respectively to --;
Line 4, "associating" should read -- association --;
Line 7, "respective of" should be deleted;
Line 8, "Processing liquid, which" should read -- processing liquid respectively, which --;
Line 9, "made ejection" should read -- made to eject --;
Line 17, "liquid ejection should read -- liquid the ejection --;
Line 24, "ration" to -- ratio --; and
Line 32, "foe" should read -- from --.

Column 8,
Line 28, "generated" should read -- generated by --;
Line 36, "in" should be deleted.; and
Line 40, "detailed" should be deleted.

Column 12,
Line 3, "generate," should read -- generate --; and
Line 22, "through" should read -- though --.

Column 13,
Line 4, "fuloropore" should read -- Fluoropore --;
Line 32, "Fuloropore" should read -- Fluoropore --; and
Line 52, "[Blak" should read -- [Black --.

Column 15,
Line 34, "agent" should read -- agent: -- ;
Line 59, "stylen-acrylic" should read -- stylen-acrylic --; and
Line 60, "methaacrylate" should read -- methacrylate --.

Column 18,
Line 59, "relative of" should read -- relative to --; and
Line 61, "respective" should read -- respective times --.

UNITED STATES PATENT AND TRADEMARK OFFICE

CERTIFICATE OF CORRECTION

PATENT NO. : 6,135,656
DATED : October 24, 2000
INVENTOR(S) : Minako Kato et al.

It is certified that error appears in the above-identified patent and that said Letters Patent is hereby corrected as shown below:

Column 19,
Line 18, "liquid ejection" should read -- liquid the ejection --;
Line 24, "to" (first occurrence) should read -- the -- and "to" (second occurrence) should be deleted;
Line 25, "respective of the" should read -- respectively to --;
Line 47, "to respective of the" should read -- respectively to the --; and
Line 64, "liquid ejection" should read -- liquid the ejection --.

Column 20,
Line 7, "associating" should read -- association --;
Line 10, "respective of " should be deleted;
Line 11, "processing liquid, which" should read -- processing liquid respectively, which --;
Line 12, "eject" should read -- to eject --;
Line 15, "ejection in respective of" should read -- ejections in respect of --.
Line 29, "correspond to" should read -- to correspond --;
Line 30, "respective of the" should read -- respectively to the --;
Line 31, "eject" should read -- to eject --;
Line 46, "liquid ejection" should read -- liquid the ejection --;
Line 54, "Ration" should read -- ratio is --;
Line 56, "correspond to respective" should read -- correspond respectively to --;
Line 57, "respective of" should be deleted;
Line 58, "associating" should read -- association --; and
Line 61, "ejection in respective of" should read -- ejections in respect of --.

UNITED STATES PATENT AND TRADEMARK OFFICE

CERTIFICATE OF CORRECTION

PATENT NO. : 6,135,656
DATED : October 24, 2000
INVENTOR(S) : Minako Kato et al.

It is certified that error appears in the above-identified patent and that said Letters Patent is hereby corrected as shown below:

Column 21,
Line 7, "correspond to" should read -- to correspond --.

Column 22,
Line 1, "respective of" should read -- respectively to --;
Line 2, "eject" should read -- to eject --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*